US011297986B2

(12) United States Patent
Towberman

(10) Patent No.: US 11,297,986 B2
(45) Date of Patent: Apr. 12, 2022

(54) CLEANING DEVICE FOR COMPACT HEATING AND/OR COOLING UNITS

(71) Applicant: NET Building Services, LLC, New Richmond, WI (US)

(72) Inventor: Jeffrey Clayton Towberman, New Richmond, WI (US)

(73) Assignee: NET BUILDING SERVICES, LLC, New Richmond, WI (US)

( * ) Notice: Subject to any disclaimer, the term of this patent is extended or adjusted under 35 U.S.C. 154(b) by 0 days.

(21) Appl. No.: 17/121,460

(22) Filed: Dec. 14, 2020

(65) Prior Publication Data

US 2021/0177224 A1 Jun. 17, 2021

Related U.S. Application Data

(60) Provisional application No. 62/947,041, filed on Dec. 12, 2019.

(51) Int. Cl.

| | |
|---|---|
| ***A47L 9/06*** | (2006.01) |
| ***B08B 1/00*** | (2006.01) |
| ***B08B 5/04*** | (2006.01) |
| ***B08B 5/02*** | (2006.01) |

(52) U.S. Cl.

CPC ..... *A47L 9/0693* (2013.01); *B08B 1/001* (2013.01); *B08B 5/02* (2013.01); *B08B 5/04* (2013.01)

(58) Field of Classification Search

CPC ..... A47L 9/0693; B08B 1/001; B08B 5/02; B08B 5/04

See application file for complete search history.

(56) References Cited

U.S. PATENT DOCUMENTS

| | | | | | |
|---|---|---|---|---|---|
| 986,245 | A * | 3/1911 | Thurman | A47L 9/02 | 15/415.1 |
| 2,811,738 | A * | 11/1957 | Gall | A47L 9/06 | 15/328 |
| 4,506,406 | A * | 3/1985 | LaMonte | A47L 4/02 | 15/398 |
| 4,694,529 | A * | 9/1987 | Choiniere | A47L 9/02 | 15/393 |
| 5,533,230 | A * | 7/1996 | Rouda | A47L 9/02 | 15/339 |
| 5,765,259 | A * | 6/1998 | Cika | A47L 4/00 | 15/394 |
| 6,026,541 | A * | 2/2000 | Bailey | A47L 5/24 | 15/344 |
| 6,370,731 | B1 * | 4/2002 | Carter | A47L 9/06 | 15/393 |
| 8,468,648 | B1 * | 6/2013 | Smith | B08B 5/04 | 15/381 |
| D714,005 | S * | 9/2014 | McGurk | D32/32 | |
| 8,918,947 | B2 * | 12/2014 | Schwartz | A47L 9/02 | 15/246.2 |

(Continued)

*Primary Examiner* — Marc Carlson

(74) *Attorney, Agent, or Firm* — Daniel J. Polglaze; Westman, Champlin & Koehler, P.A.

(57) ABSTRACT

A cleaning device for a compact HVAC unit includes a flexible belt, and a collection element attached to the flexible belt at a first end of the belt. The collection element and the belt form a collection area therebetween, and wherein the collection element has a port therein at the first end of the belt, the port configured to remove debris collected in the collection area.

20 Claims, 17 Drawing Sheets

(56) References Cited

U.S. PATENT DOCUMENTS

| | | | | |
|---|---|---|---|---|
| 8,931,135 | B1 * | 1/2015 | Sangster | B08B 5/04 15/314 |
| D767,225 | S * | 9/2016 | Cole | D32/32 |
| D868,406 | S * | 11/2019 | Bond | D32/32 |
| 10,631,696 | B1 * | 4/2020 | Williamson | A47L 9/0693 |
| 10,791,899 | B2 * | 10/2020 | Carter | A47L 9/242 |
| D917,121 | S * | 4/2021 | Enning | D32/32 |
| 2007/0033766 | A1 * | 2/2007 | Livingston | B08B 9/043 15/353 |
| 2007/0209154 | A1 * | 9/2007 | Griffith | A47L 7/04 15/415.1 |
| 2008/0120802 | A1 * | 5/2008 | Harvey | B05B 1/205 15/405 |
| 2009/0230217 | A1 * | 9/2009 | Stone | F28G 1/166 239/525 |
| 2010/0170060 | A1 * | 7/2010 | Eccardt | A47L 5/36 15/415.1 |
| 2011/0277270 | A1 * | 11/2011 | Knopow | A47L 5/24 15/405 |
| 2015/0047673 | A1 * | 2/2015 | White | B08B 7/0092 134/7 |
| 2015/0223656 | A1 * | 8/2015 | Tucker | A47L 9/0693 15/398 |
| 2018/0243805 | A1 * | 8/2018 | Davis | B08B 9/035 |
| 2019/0178593 | A1 * | 6/2019 | Boye | B08B 3/02 |
| 2019/0239708 | A1 * | 8/2019 | Carter | A47L 9/0693 |
| 2020/0214517 | A1 * | 7/2020 | Ito | A47L 9/02 |

* cited by examiner

CLEANING DEVICE FOR COMPACT HEATING AND/OR COOLING UNITS

CROSS-REFERENCE TO RELATED APPLICATION

The present application is based on and claims the benefit of U.S. provisional patent application Ser. No. 62/947,041, filed Dec. 12, 2019, the content of which is hereby incorporated by reference in its entirety.

SUMMARY

In one embodiment, a cleaning device for a compact HVAC unit includes a flexible belt, and a collection element attached to the flexible belt at a first end of the belt. The collection element and the belt form a collection area therebetween, and wherein the collection element has a port therein at the first end of the belt, the port configured to remove debris collected in the collection area.

In other aspects of the cleaning device, the flexible belt has a bent end portion at an opposite end of the belt from the collection element. The bent portion is bent in one aspect in a direction toward the collection element to form a deflection portion that assists in introducing the cleaning device into compact HVAC unit. The belt includes in one aspect at least one notch to assist in alignment of the cleaning device in an interior of the HVAC unit. The at least one notch is positioned near the port and is configured to engage an interior wall portion of the HVAC unit. In one aspect, the flexible belt is formed from aluminum. In another aspect, the collection area is a pocket into which debris is blown, the pocket formed from the collection element and apportion of the belt. The port in one aspect is configured to attach to an external vacuum to allow suction of debris from the collection area. The port is in one aspect positioned to be at a bottom of the cleaning device when installed for cleaning of the HVAC unit.

In another embodiment, a method includes inserting a cleaning device, having a flexible belt, a debris collection area, and a debris removal port, between a wall and a condenser coil of an HVAC unit, blowing debris collected in the HVAC unit along the belt toward the debris collection area, and removing the debris collected in the debris collection area via the port and an external vacuum.

Other aspects of the method include inserting at one end of a condenser coil of the HVAC unit and introducing the cleaning belt around the condenser coil to an opposite side of the HVAC unit. Further aspects include the vacuum port being positioned at a low part of the HVAC unit for cleaning; blowing debris is performed from an end of the cleaning device opposite the vacuum port, toward the collection element and the vacuum port; the collection element and the belt forming a pocket for collecting debris, and wherein removing collected debris comprises vacuuming the collected debris from the pocket.

In another embodiment, a method includes inserting a cleaning device between a wall and a condenser coil of an HVAC unit, the cleaning device comprising a belt that wraps at least partially around the condenser coil, a collection element on the belt to collect debris, and a vacuum port configured to remove collected debris from the collection element; blowing debris collected in the HVAC unit toward the collection element along the belt; and removing collected debris with the vacuum port and an external vacuum.

BRIEF DESCRIPTION OF THE DRAWINGS

FIG. 19 illustrates an opening between a wall and a condenser coil such as on a unit as shown in FIG. 5; and FIG. 20 is a top view of a cleaning device such as that shown in FIGS. 1A-1C and FIGS. 2-4 in place on a heating and/or cooling unit.

DETAILED DESCRIPTION OF ILLUSTRATIVE EMBODIMENTS

Embodiments of the present disclosure provide apparatuses and methods to efficiently remove dirt, dust, and debris from a compact heating and cooling unit. A debris catching cleaning device is provided for the cleaning of non-removable cooling chassis on, for example, compact heating and cooling units. Such units, including by way of example only and not by way of limitation, include units manufactured by Magic-Pak, Comfort Pack, Condo Pak and other manufacturers. The units are traditionally a vertical compact heating and cooling unit that has a non-removable cooling chassis. Such units are traditionally lower cost than full-house or full-building units, typically costing in the neighborhood of $4,000 and more. Their compact nature and non-removable chassis makes keeping the units clean a difficult process. The heating and/or cooling units may be referred to in this application as heating, ventilating, and cooling (HVAC) units.

The cooling chassis of a heating/cooling unit such as those described typically contains a condenser surrounded by a condenser coil that has fins or the like. Debris such as blowing leaves, cottonwood, and the like, can accumulate in the condenser coil. The buildup of dirt and debris is not easily removed from the condenser coil. The inability to properly remove dirt and debris will cause the unit to run harder and therefore reduce the efficiency and length of life of the entire unit. Such units do not have readily available major replacement parts, so a failed unit will result in a full replacement unit being required.

Cleaning of such units is typically performed by using compressed oxygen or straight air and blowing debris out of the condenser coil into any open space within the unit where it can and will reside until the unit is fired up. This creates static on the coil to which the debris will cling to all over again, or the debris may be blown out a louver to an outside of the building. The blown debris may cause an aesthetic issue on a higher-end building such as an apartment complex or the like. Further, if units are cleaned in this manner and not cleaned in a proper order, such as if the level below has already been cleaned, when the unit above is cleaned and that dirt and debris does make it out of the louver, gravity will take it and bring it down to the previously cleaned unit. If that previously cleaned unit is running, the debris will again be sucked into the running unit to the static on the coil and the debris will re-enter the already cleaned unit.

Embodiments of the present disclosure provide an apparatus and method for the cleaning of compact heating and cooling units that addresses not only the problems of cleaning dirt and debris, but also the collection thereof to prevent cleaned debris being reintroduced into the unit or other nearby units.

Figure 5:
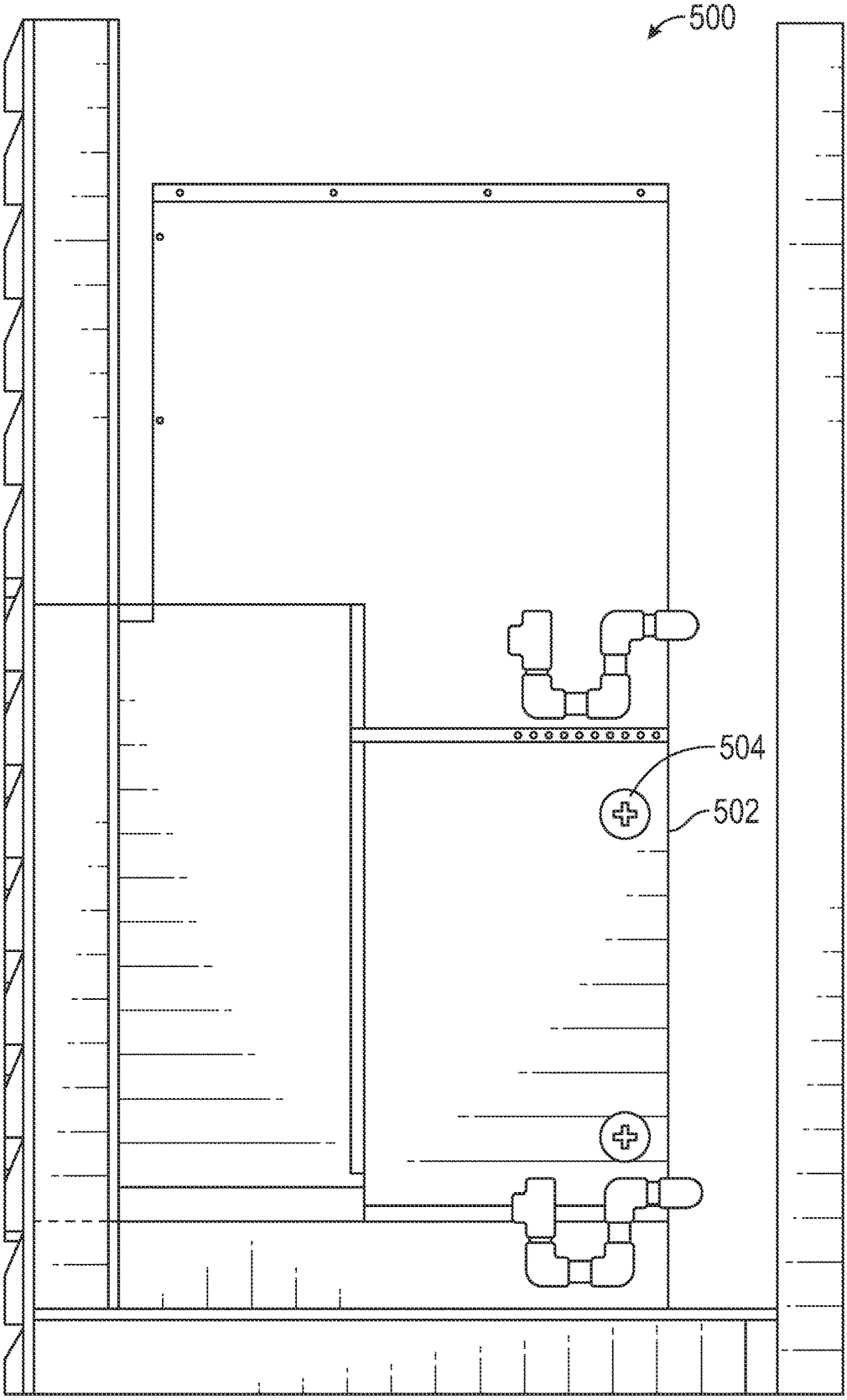
FIG. 5 is a block diagram of a heating and/or cooling unit on which embodiments of the present disclosure may be used.

A typical compact heating and/or cooling unit 500 is shown in partial cutaway side view in FIG. 5. Unit 500 has a face plate 502 that when removed allows access to, among other parts, a condenser 508 and a condenser coil 506 (see also FIGS. 6-20). The condenser coil 506 is held to a wall of the unit 500 by, for example, a set of coil screws 502. Once the face plate 502 and the coil screws 504 are removed, a cleaning device such as devices 100 or 200 described further below may be used to clean the condenser coil 506 efficiently.

Figure 1A:
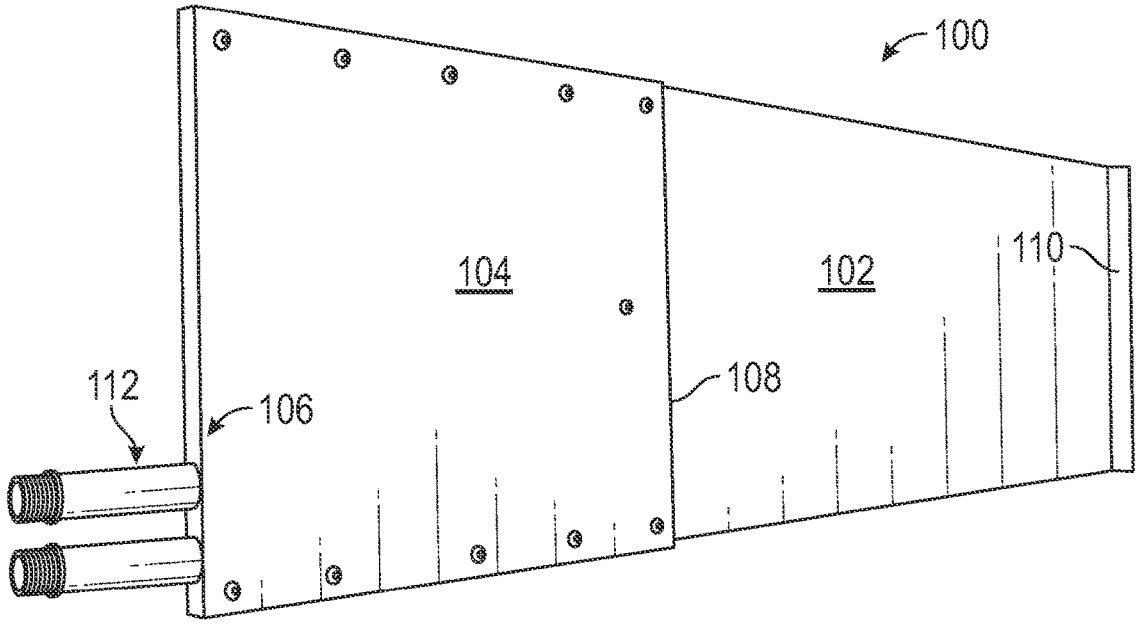
FIG. 1A is a perspective view of a cleaning device according to an embodiment of the present disclosure.
Figure 1B:
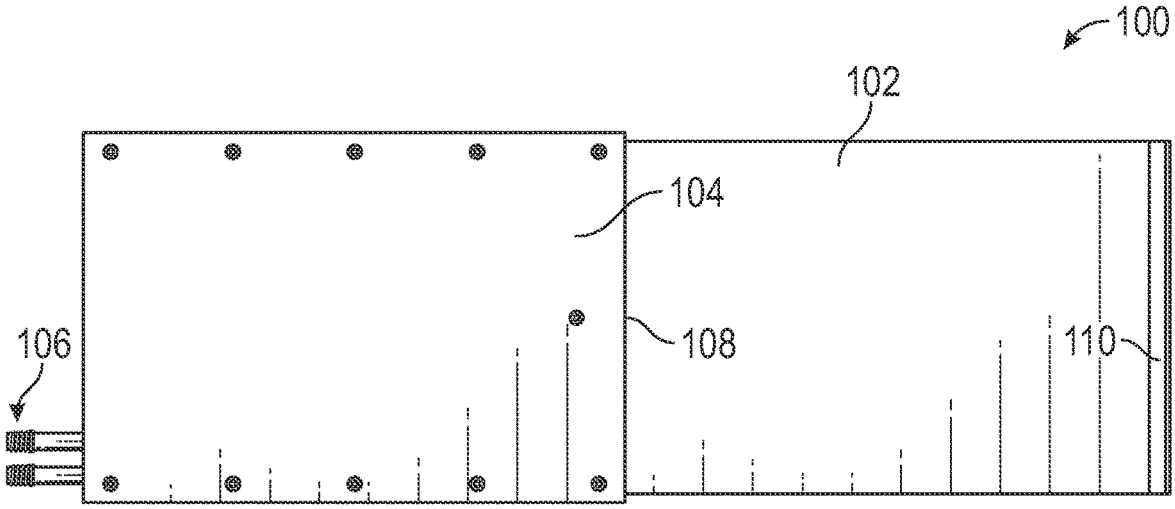
FIG. 1B is a top view of the cleaning device of FIG. 1A.
Figure 1C:
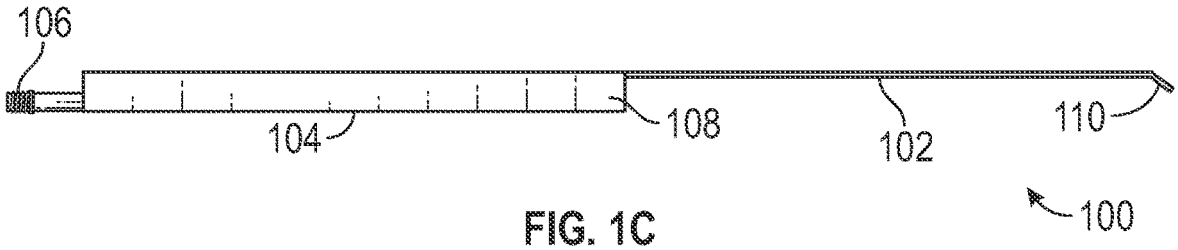
FIG. 1C is a side elevation view of the cleaning device of FIG. 1A.
Figure 2:
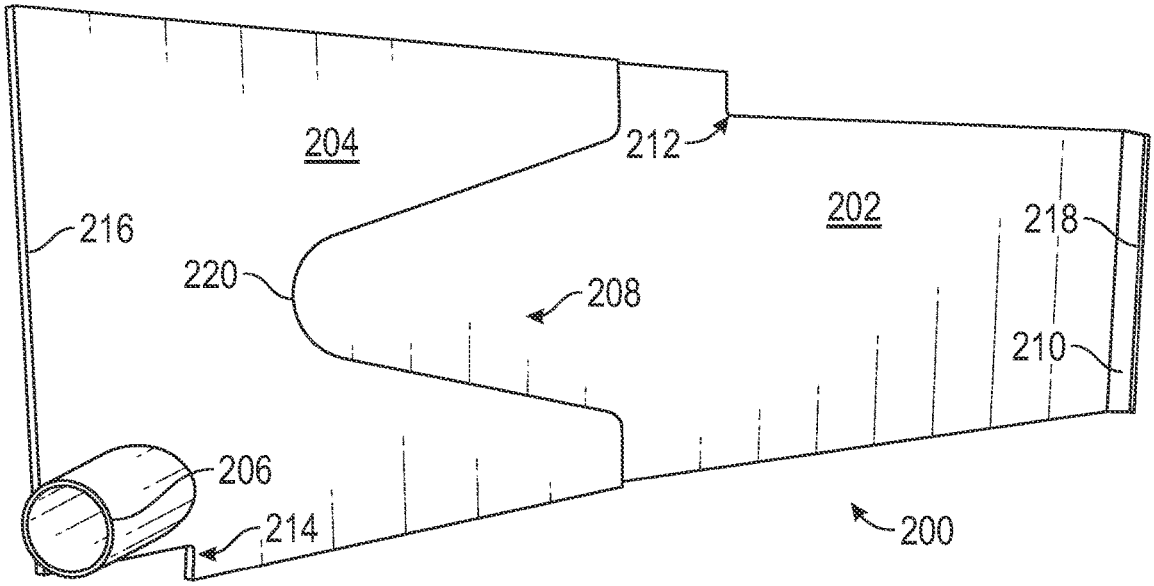
FIG. 2 is a perspective view of a cleaning device according to another embodiment of the present disclosure.
Figure 3:
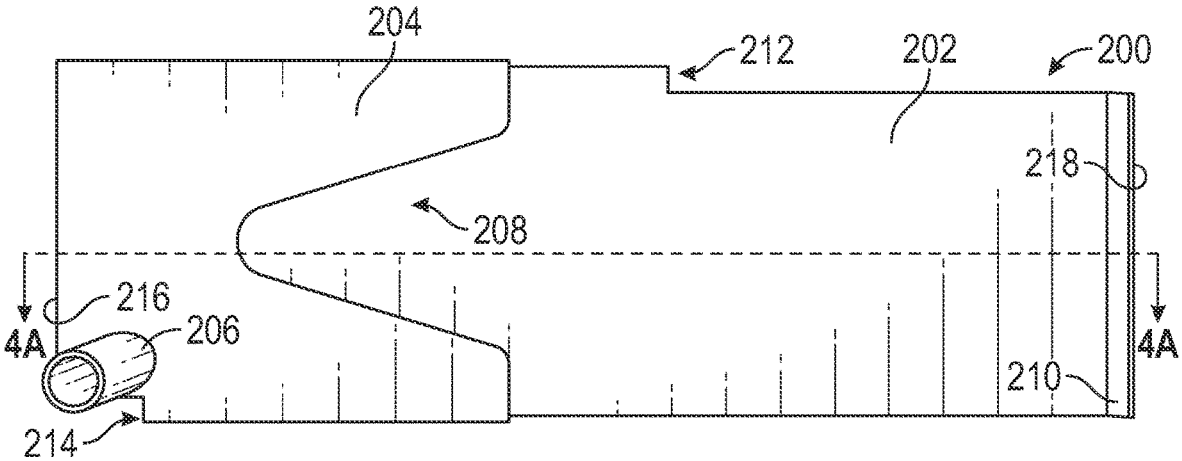
FIG. 3 is a top view of the cleaning device of FIG. 2.

FIGS. 1A-1C show a first embodiment 100 of a cleaning device according to an embodiment of the present disclosure. FIGS. 2-4B show a second embodiment 200 of a cleaning device according to another embodiment of the present disclosure.

Referring to FIGS. 1A-1C, cleaning device 100 comprises a flexible belt 102 to which a collection element 104 is attached at a first end of the belt 102. At an opposite end of the belt 102, the belt has a bent section 110 for assistance in engaging a wall of a heating and/or cooling unit such as HVAC unit 500. Collection element 104 and that portion of belt 102 that element 104 covers forms a collection area or pocket 108 into which dirt and debris from an interior of the HVAC unit may be blown. A vacuum or other suction port 106 has in this embodiment a set of pipes 112 that couple to the collection area 108. A vacuum or other suction device may be attached to the pipes 112 of the vacuum port 106 to remove debris and dirt collected in the collection area 108. Dirt and debris is moved to the collection area as described below.

Referring to FIGS. 2-4B, cleaning device 200 according to another embodiment comprises a flexible belt 202 to which a collection element 204 is attached at a first end 216 of the belt 202. At an opposite end 218 of the belt 202, the belt 200 has a bent section 210 for assistance in engaging a wall of a heating and/or cooling unit such as HVAC unit 500. Collection element 204 and that portion of belt 202 that element 204 covers forms a collection area or pocket 208 into which dirt and debris may be blown. A vacuum or other suction port 206 has in this embodiment a port coupled to the collection area 208 to remove dirt and debris from the collection area 208, and which is suitable for connection to a vacuum or other suction device to remove debris and dirt collected in the collection area 208. Dirt and debris is moved to the collection area as described below.

In one embodiment, a pair of notches 212 and 214 are present in the belt 202 to assist in alignment of the device 200 within a heating and cooling unit such as unit 500. It should be understood that heating and cooling units from different manufacturers may be slightly different and therefore the notches 212 and 214 may be present or not, and may be sized differently, to accommodate different units 500, without departing from the scope of the disclosure. Further, it should be understood that the length and width of the belt 202 (and of belt 102) may be changed to accommodate those different sizes of units, also without departing from the scope of the disclosure.

The collection element 204 in one embodiment includes a v-shaped notch 220 therein, with the open end of the v-shape positioned away from the vacuum port 206 toward the end 218 of the belt 202.

Figure 4A:
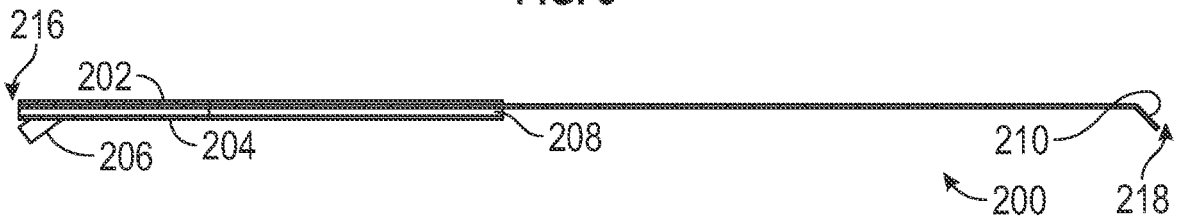
FIG. 4A is a side elevation view of the cleaning device of FIG. 2.
Figure 4B:
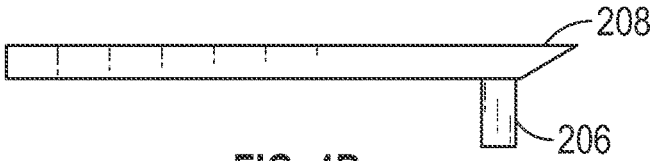
FIG. 4B is an end elevation view of an alternate pocket design of the cleaning device of FIG. 2.

In one embodiment, that portion of the collection element 204 that is in the vicinity of the vacuum port 206 is tapered from a full width at the vacuum port to a smaller width at a bottom of the cleaning device 200, as shown in the end elevation view of FIG. 4B. This is done to allow for more easy placement of the cleaning device 200 into an HVAC unit. Dimensions of the cleaning device 200 may be altered depending on the size of the HVAC unit, but such modifications are within the scope of the disclosure.

FIGS. 6-18 show a method for cleaning a unit such as unit 500 with the device 200. It should be understood that cleaning with the device 100 is very similar, although not described in detail.

Figure 6:
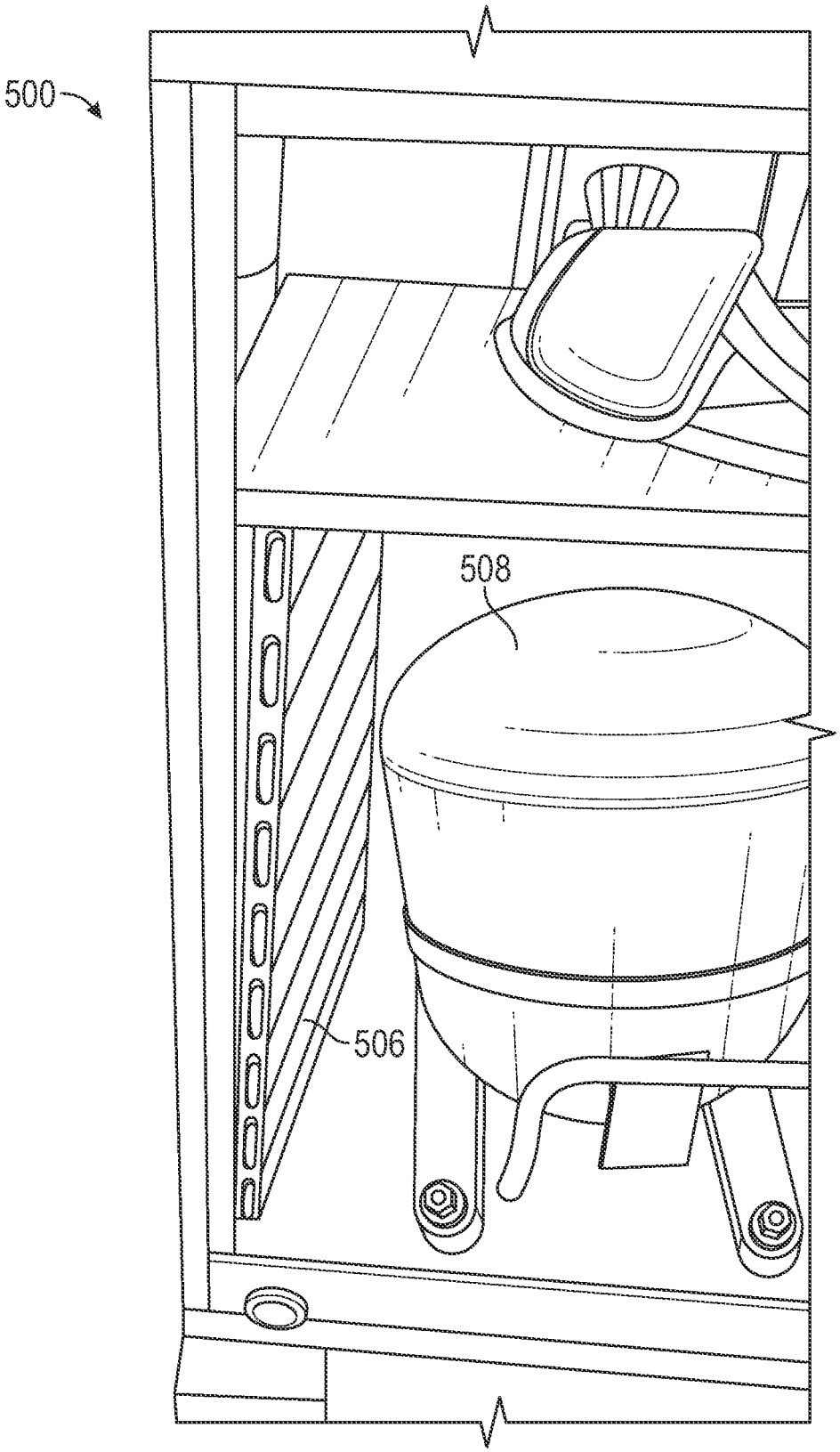
FIGS. 6-12 show insertion of the device of FIGS. 2-4 into a unit such as that shown in FIG. 5.
Figure 7:
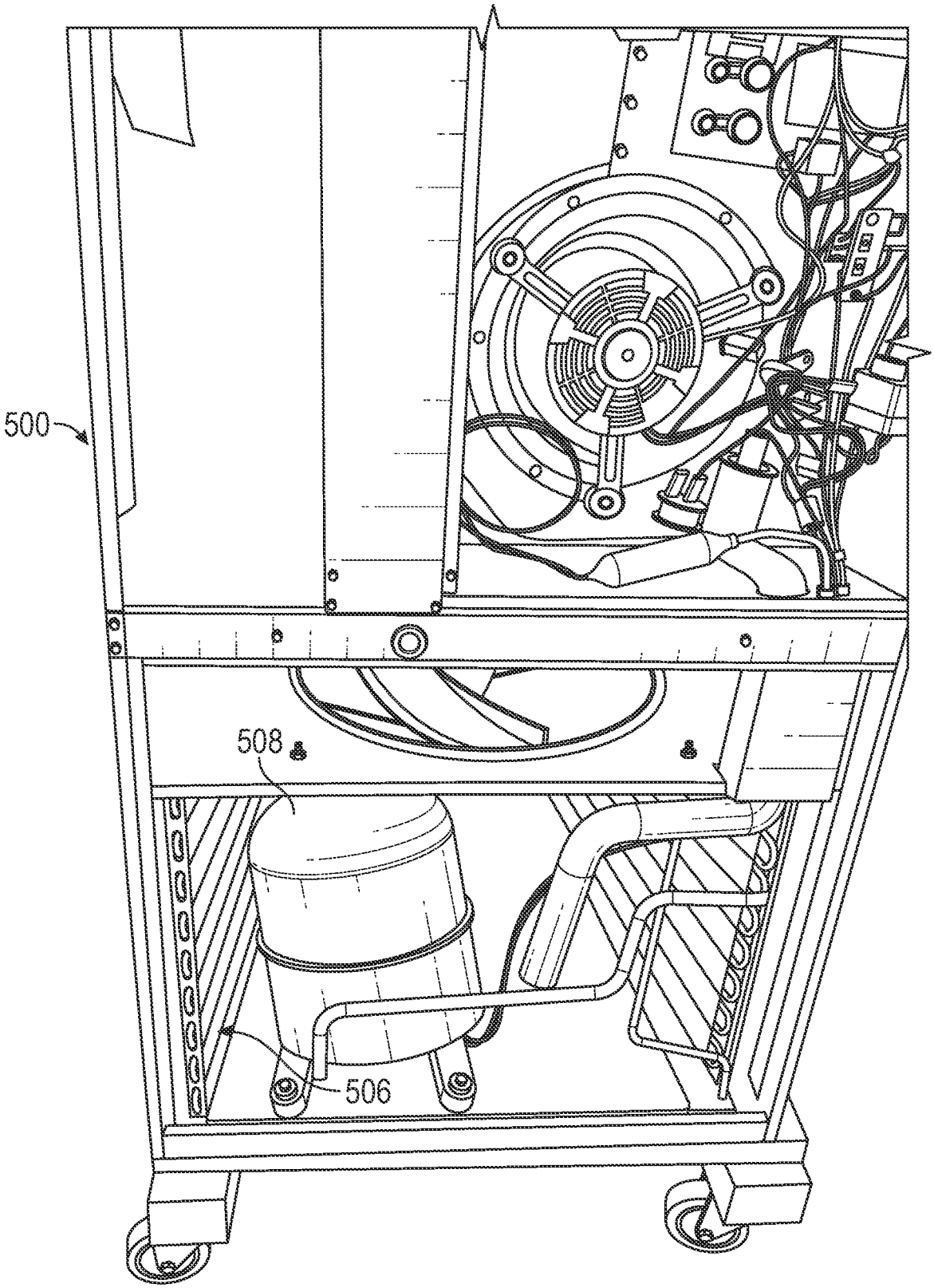
Figure 8:
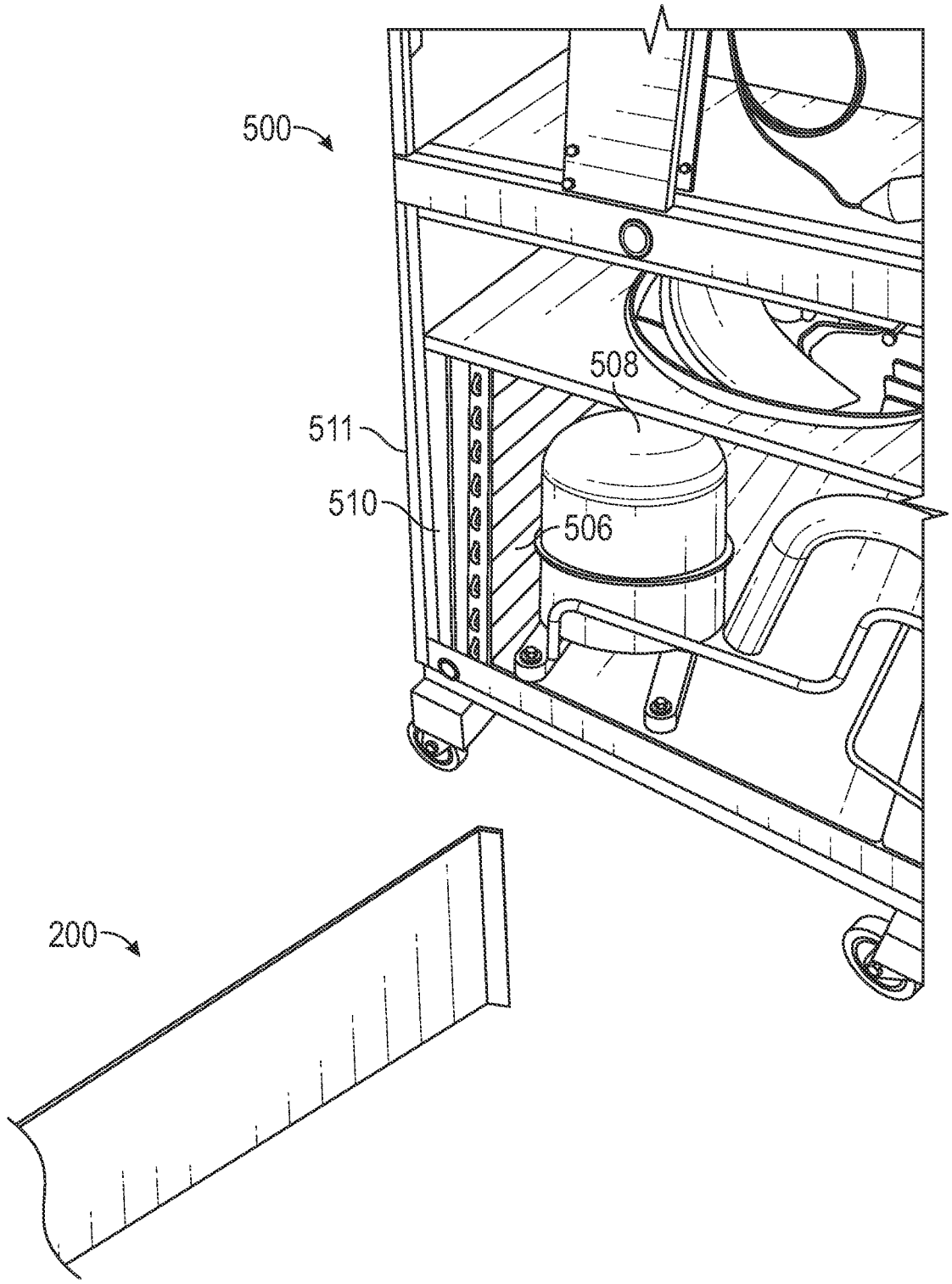

A face plate such as plated 502 is removed from unit 500. FIG. 6 shows a unit 500 with its face plate 502 already removed, exposing a compartment containing the condenser coil 506 and condenser 508. Operation of such units is well known and will not be described further herein. In FIG. 7, the coil screws 504 are removed to allow the condenser coil 506 to be moved within the compartment. FIG. 8 shows the movement of condenser coil 506 to create an opening 510 between the interior wall 511 of the compartment and the condenser coil 506.

After the front panel 502 of the unit 500 is removed and the screws 504 that hold the condenser coil 506 in place are removed the device 200 is inserted into the unit 500 as shown in FIGS. 9-12. When installing the device 200 (or 100) the bent section 210 of the belt 202 is introduced into the compartment first, with the bend facing toward the interior of the unit, and will engage a wall on the back of the compartment, which in turn makes the belt 202 of the device 200 deflect to the right (in the FIGS. as shown) at the back of the compartment and wrap around the condenser coil 506 (see also FIGS. 13-15).

Figure 9:
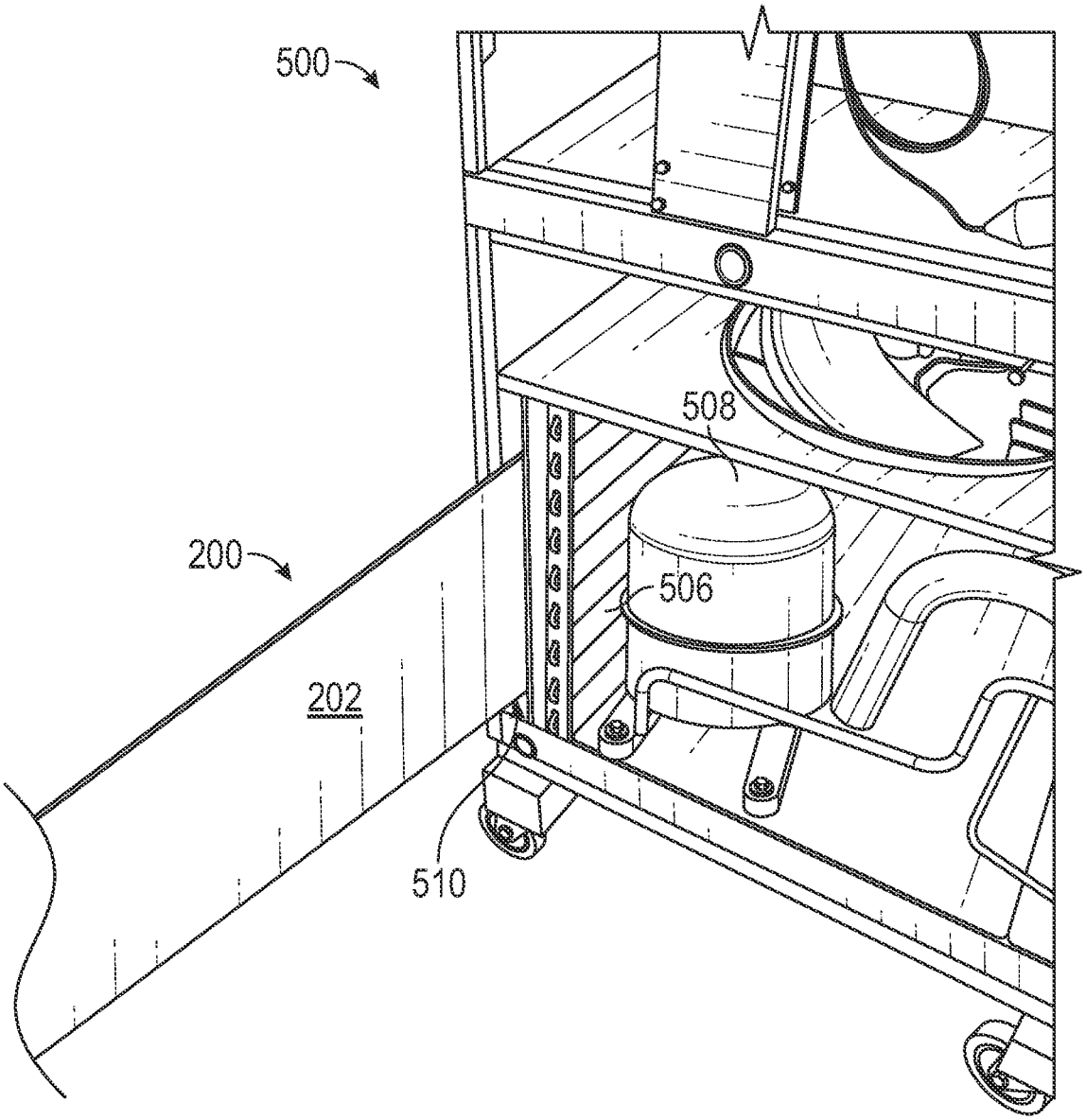
Figure 10:
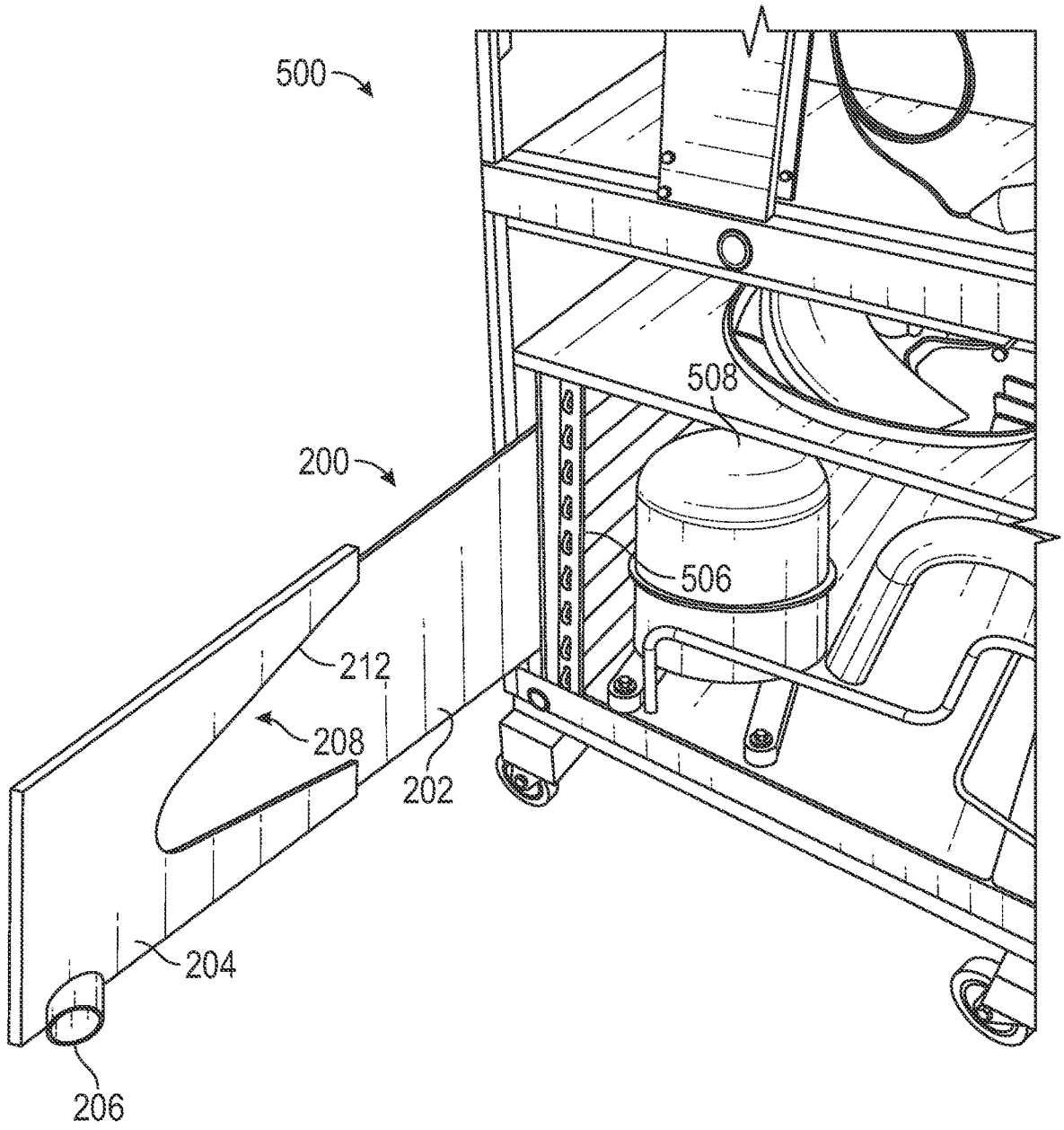
Figure 11:
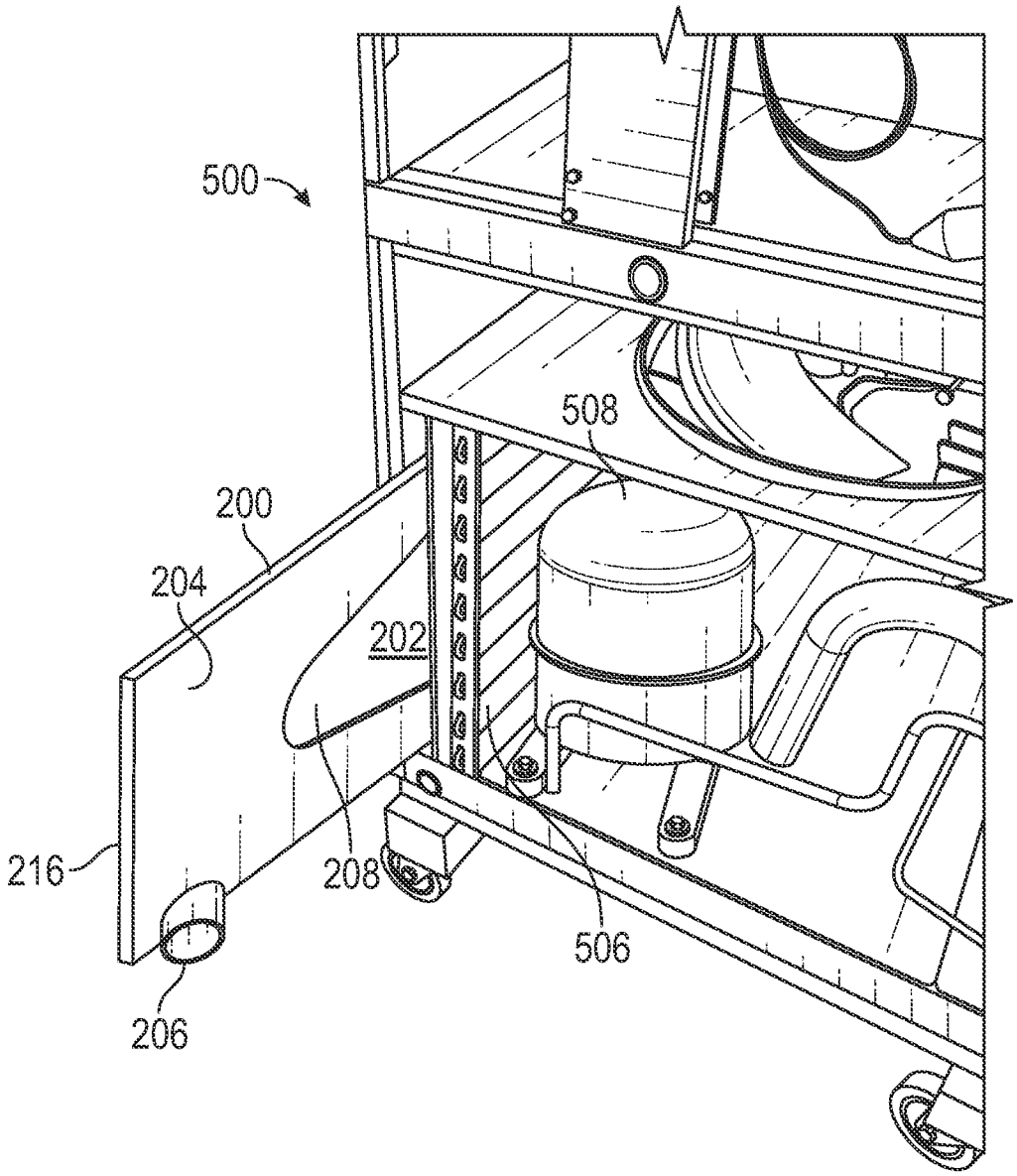
Figure 12:
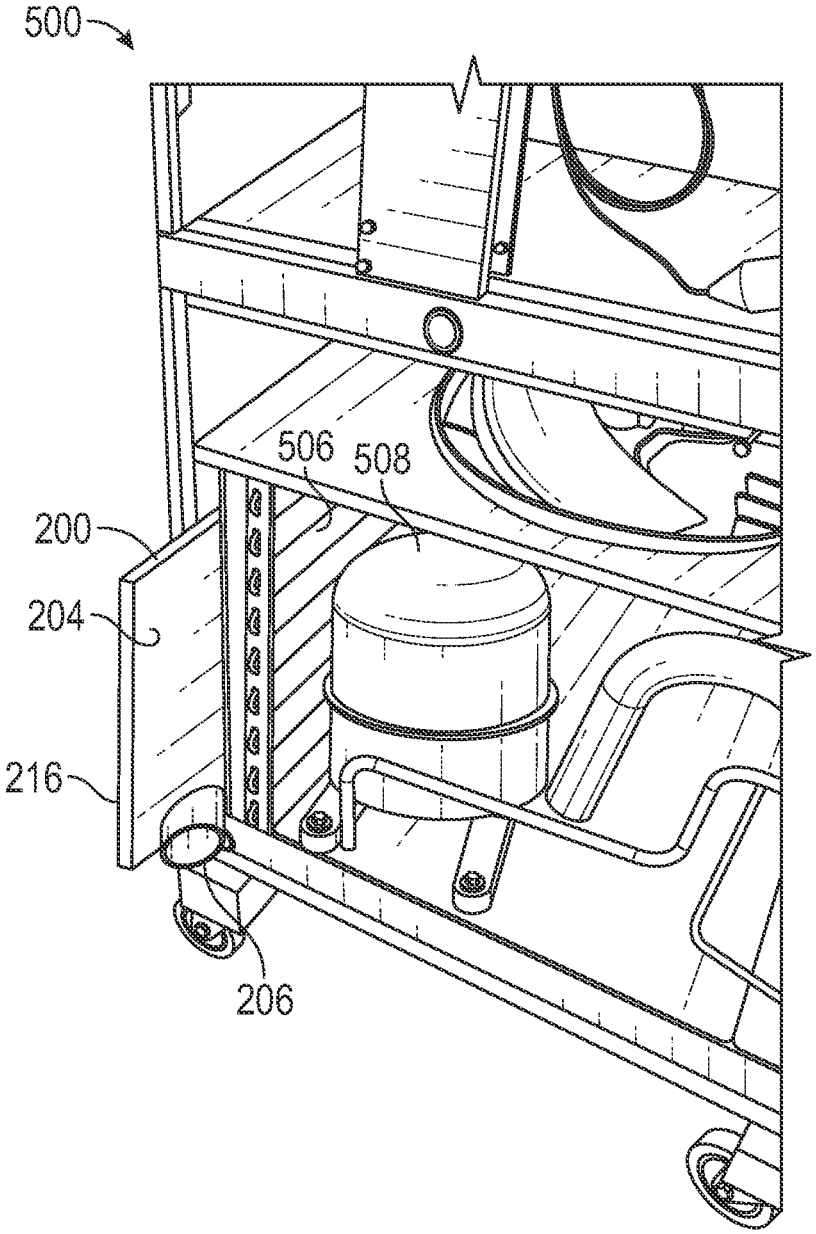

FIGS. 9-10 show the beginning of an insertion of the device 200 into opening 210 between the wall 511 and the condenser coil 506. In FIG. 11, the device is partially inserted to the point where the collection element 204 is being inserted into the opening 510. As the belt 204 wraps around the condenser coil, the device 200 is inserted all the way until the notch 214 engages a base of the interior wall (e.g., the wall sleeve base), as shown in FIG. 12. Notch 212 may similarly engage a portion of the interior wall (not shown).

Figure 13:
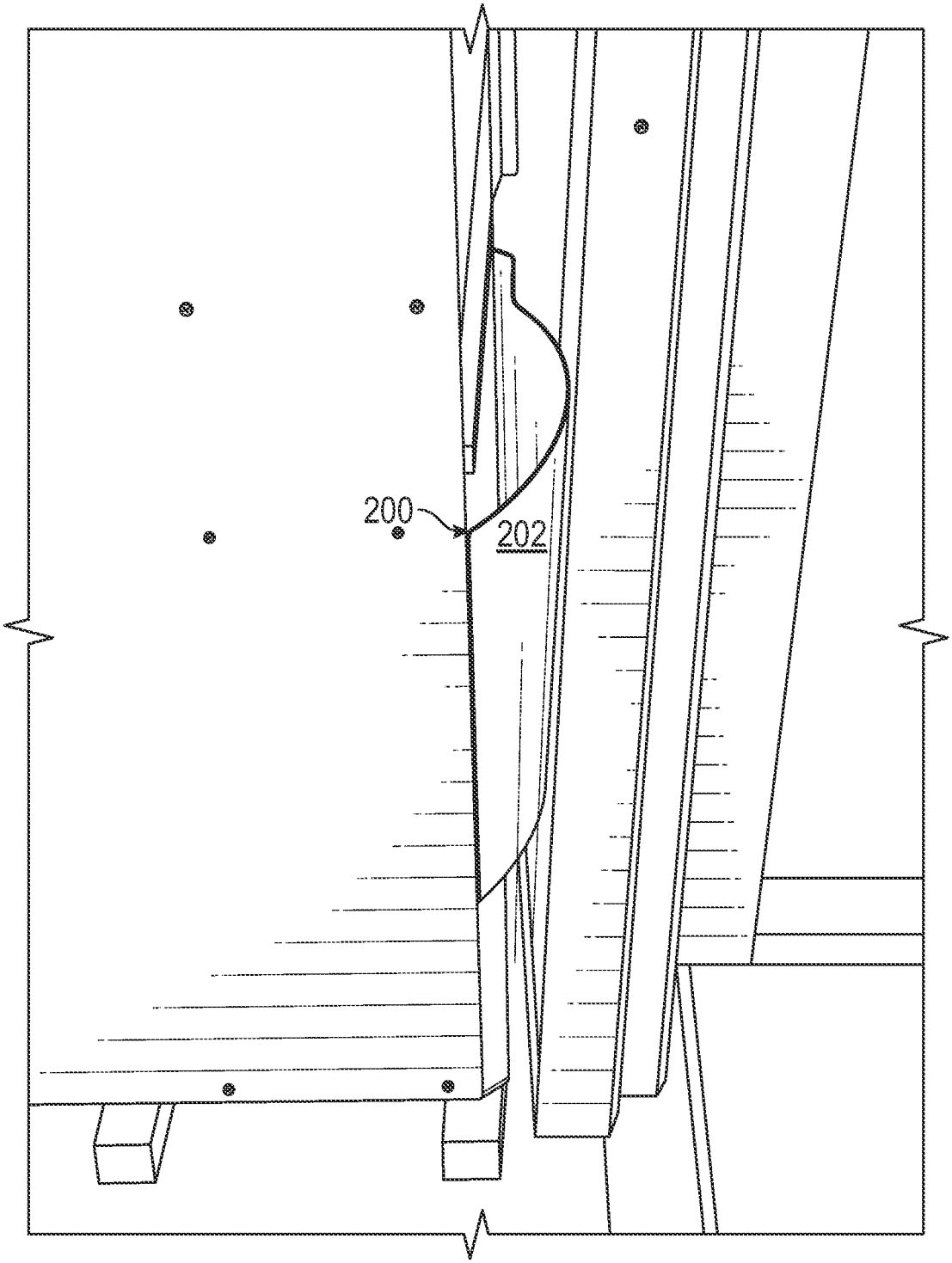
FIGS. 13-15 and 19-20 show positioning of the device of FIG. 2 in a unit such as that shown in FIG. 5.
Figure 14:
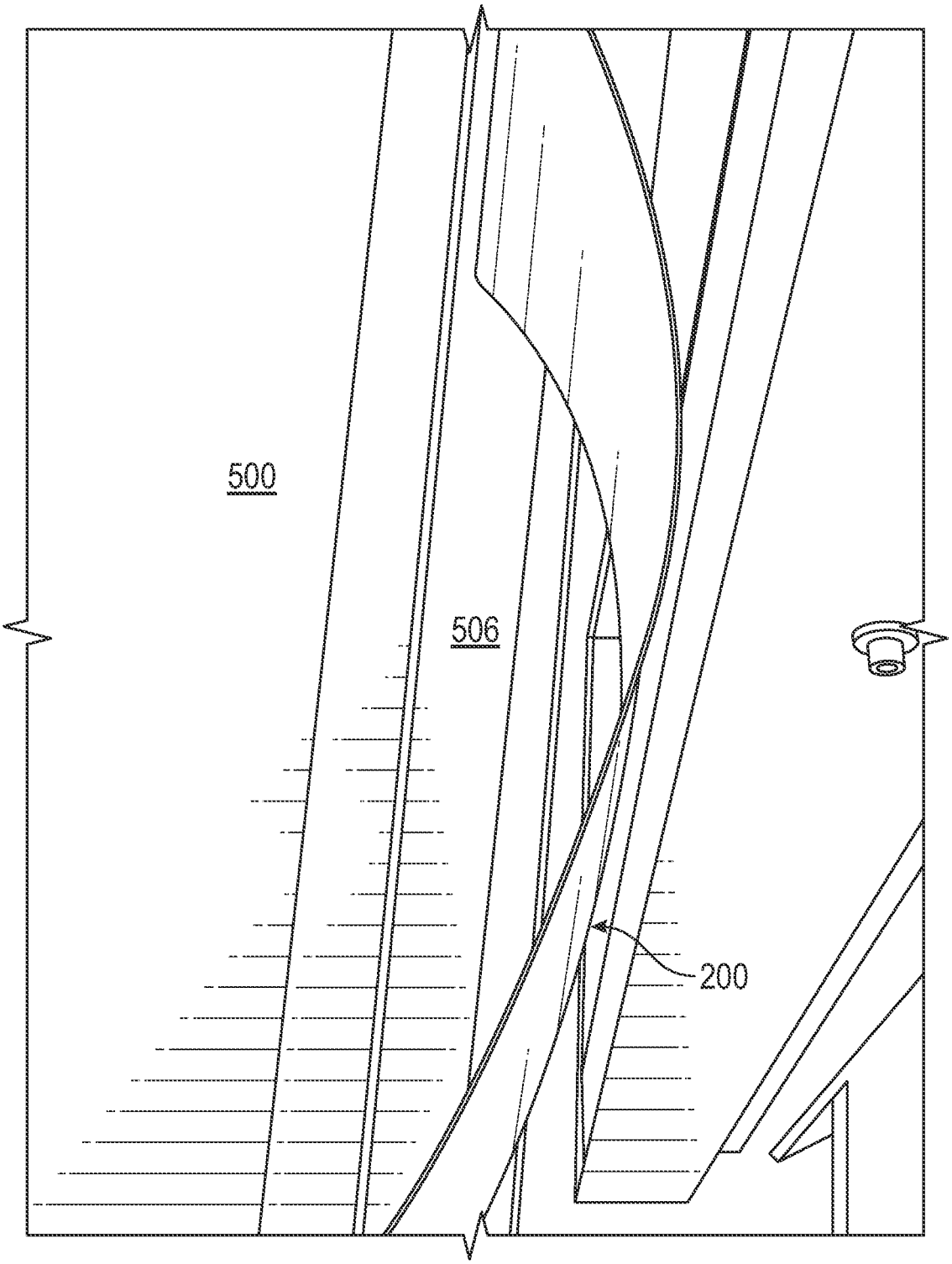
Figure 15:
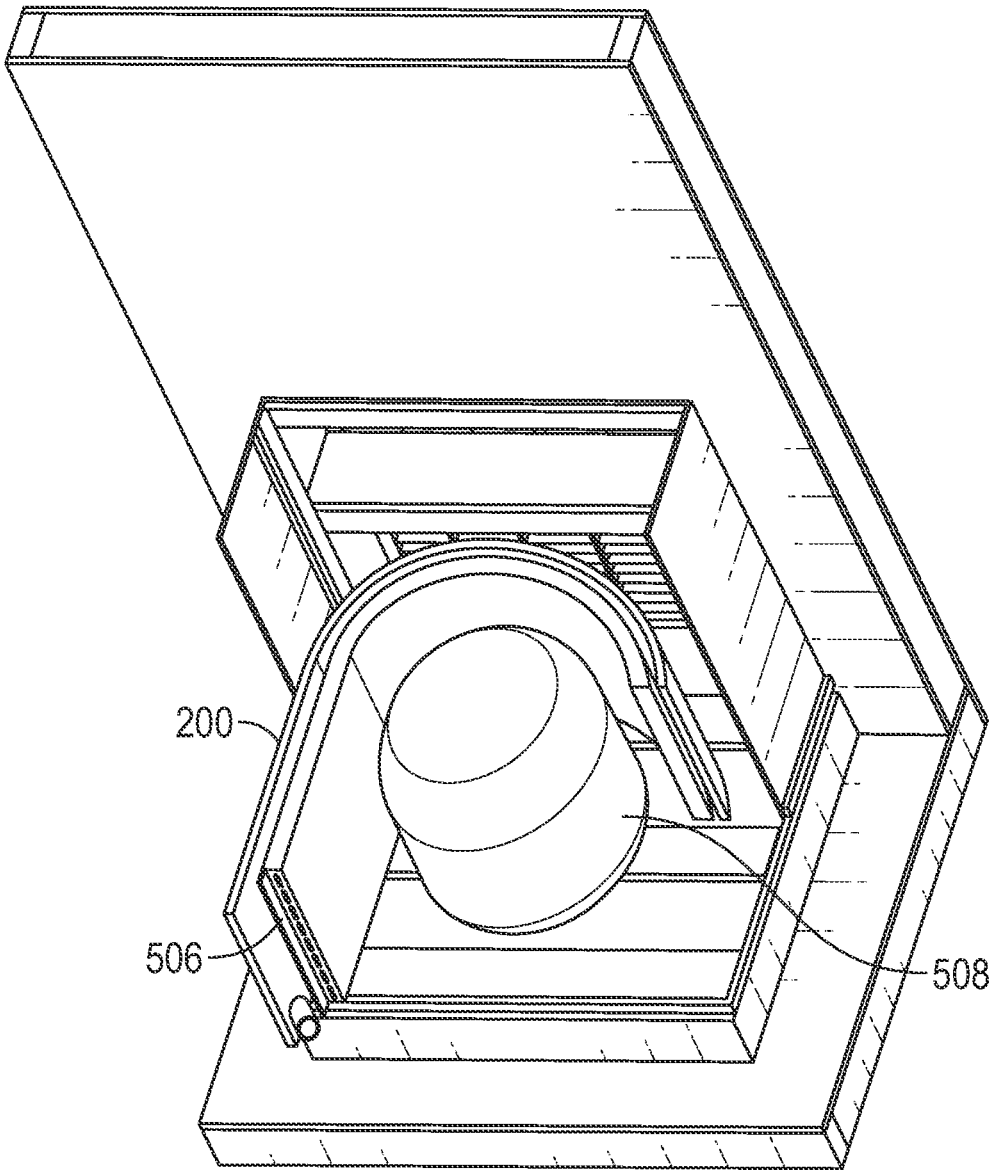
Figure 16:
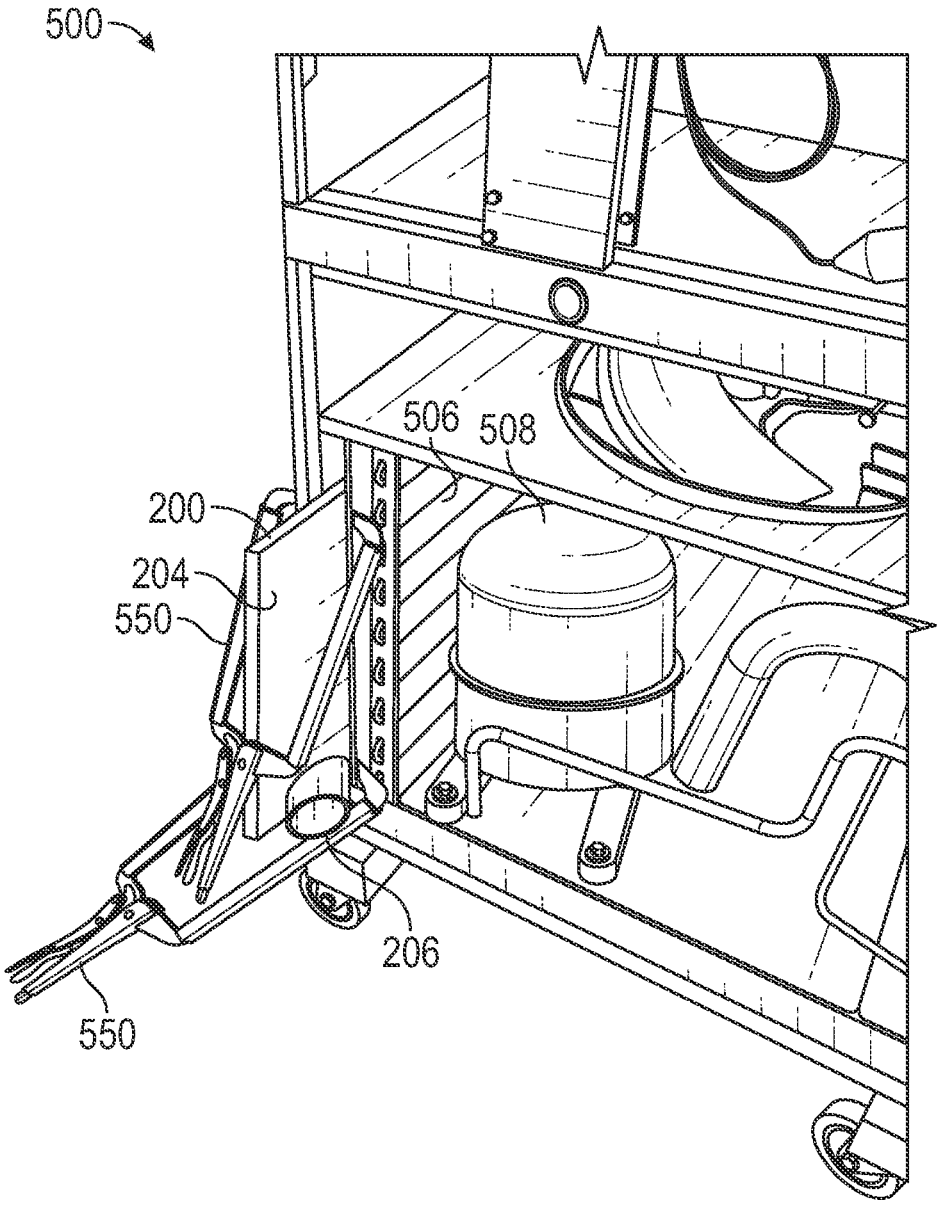
FIGS. 16-18 are views showing operation of the device once properly positioned in a heating and/or cooling unit.
Figure 17:
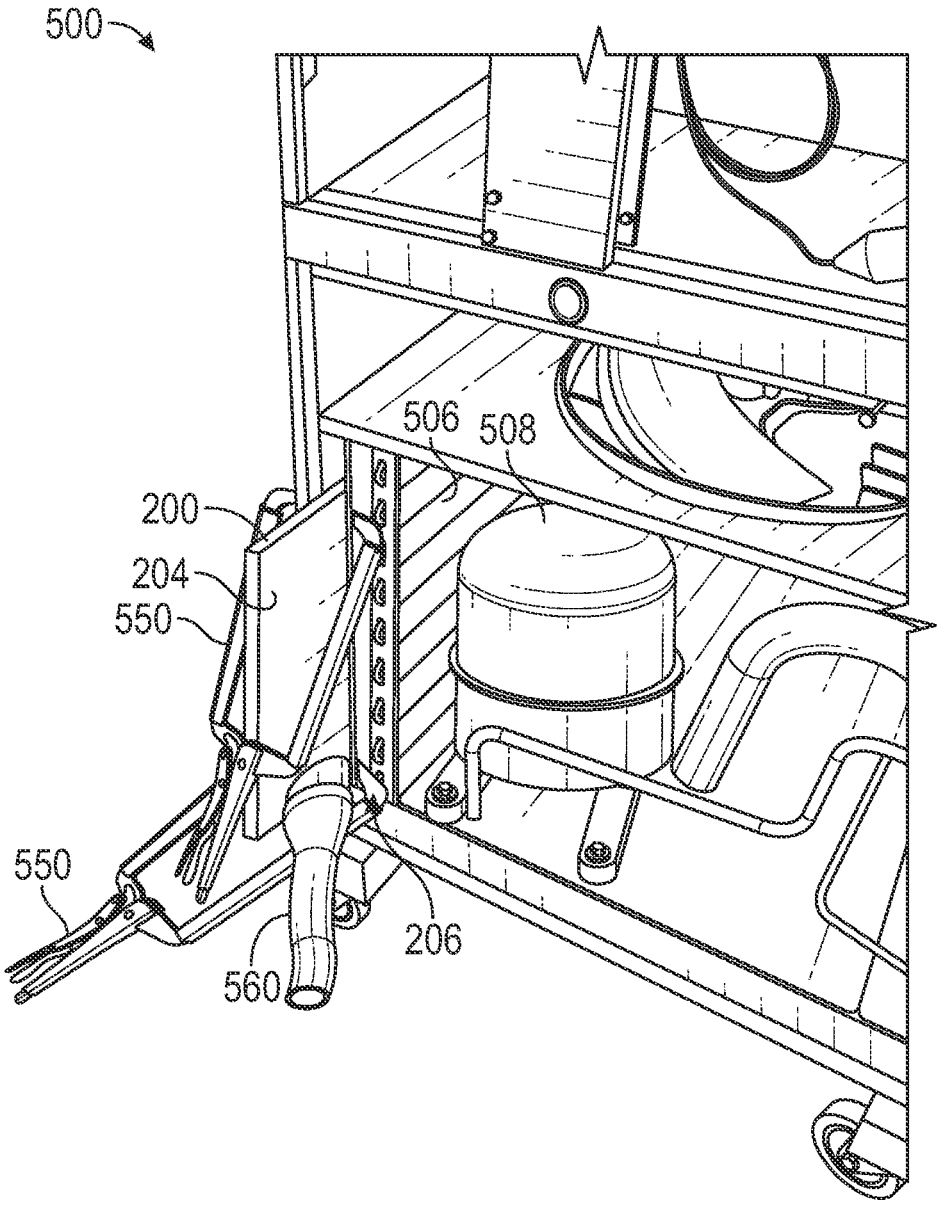
Figure 18:
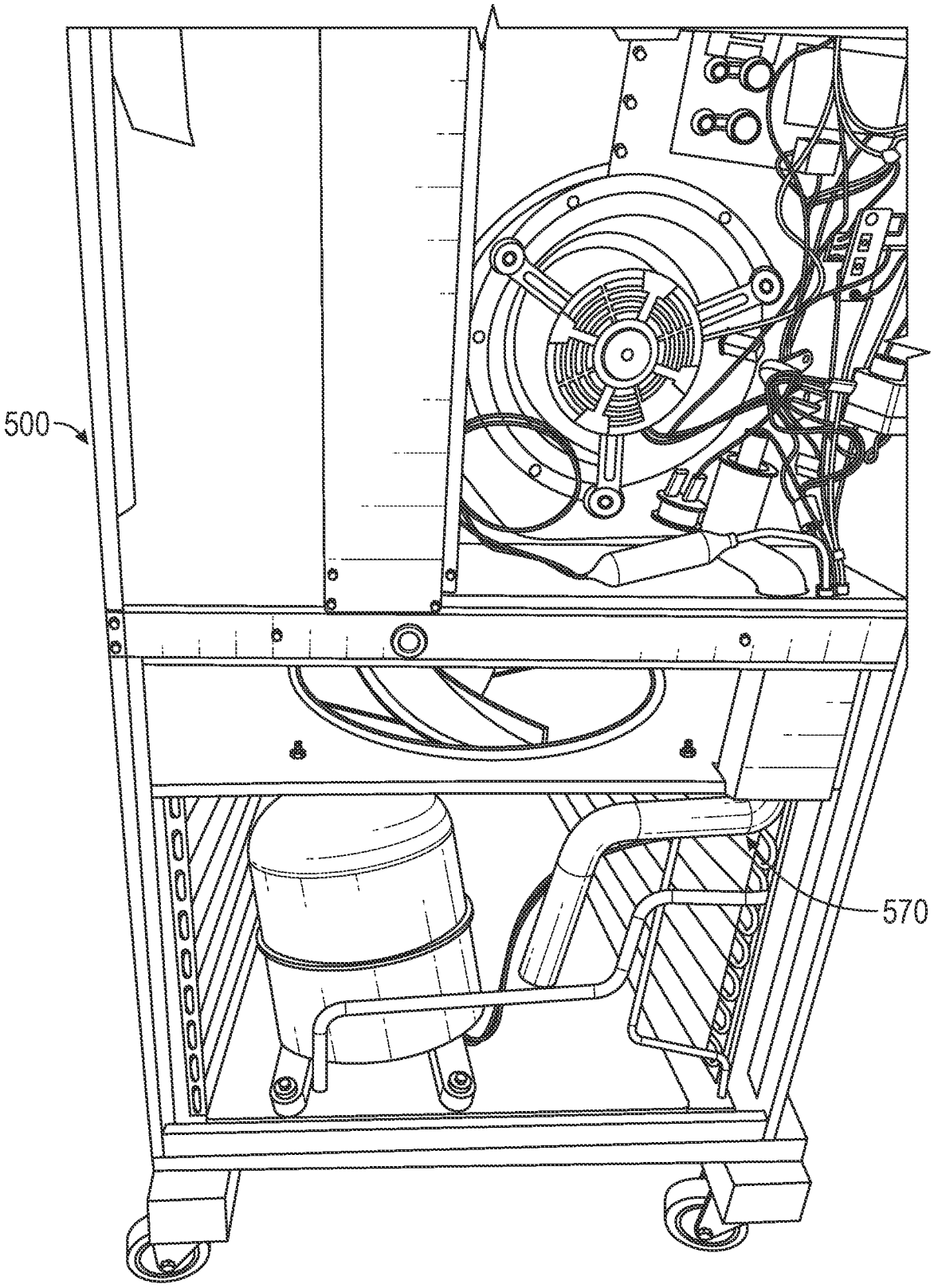

FIGS. 13-15 show the belt 202 wrapping around the condenser coil 506 at a back of the compartment containing the condenser coil 506 and the condenser 508. Once the device 200 is fully inserted, it is clamped to the condenser coil 506 for example using clamps 550 to hold the device 200 in place and to reduce excess suction loss from a vacuum, as shown in FIG. 16. FIG. 17 shows attachment of a vacuum hose 560 to the vacuum port 206 for the removal of debris or dirt collected in the collection area 208.

The clamps 550 are added to maintain as much of a vacuum as possible. In one embodiment, the vacuum hose 560 is connected to a large CFM vacuum external to the unit. Then, air is blown into the opposite side of the unit as indicated at arrow 570 in FIG. 18. The air blows dust, debris and dirt toward the back of the unit 500, where it hits the belt 202 that has been inserted. The dirt, dust, and debris is blown against the belt 202 and into the collection area 208 while blowing air on the condenser coil to remove debris. The device 200 catches or at least stops the debris from leaving the unit 500. The blowing air moves the dirt and debris counterclockwise around the condenser coil 506, and with the blowing air the debris is guided to the collection area 208 and is removed by application of suction from the vacuum through the vacuum port 206. This removes a large portion of the debris without blowing the debris out of the unit to collect in other units, and without leaving the debris in the unit 500 to be collected on the condenser coil 506 again.

Figure 20:
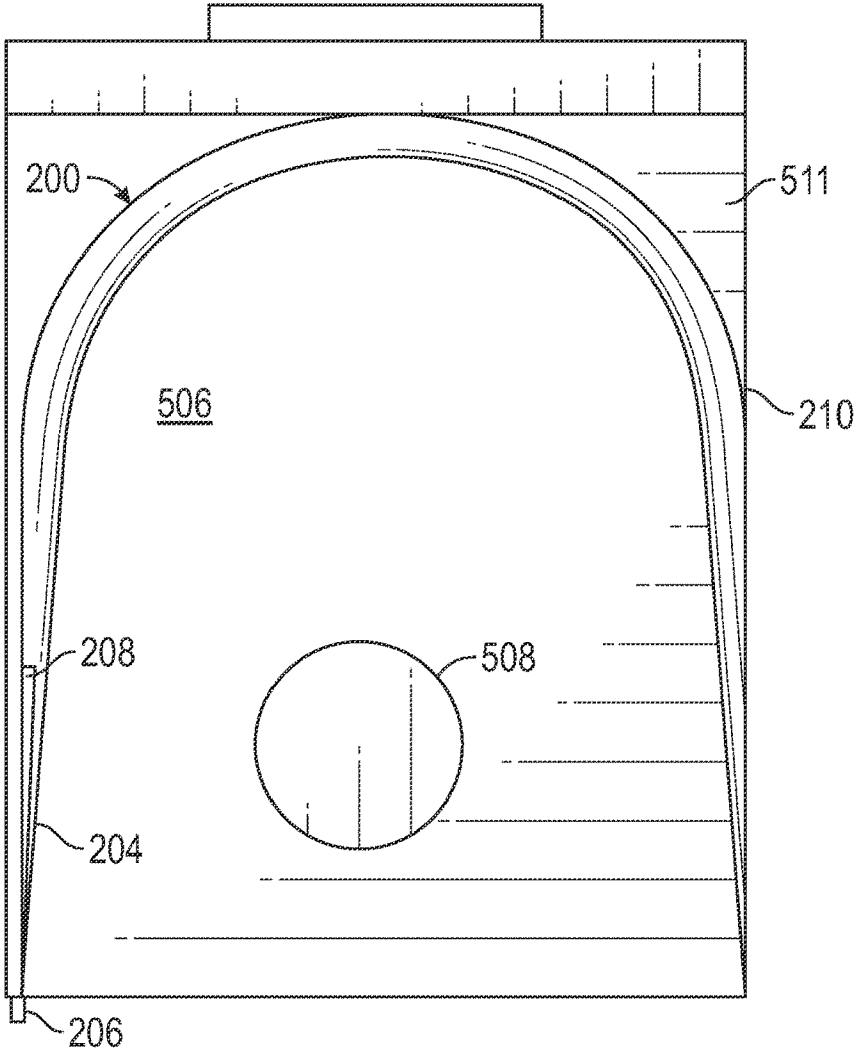
Figure 19:
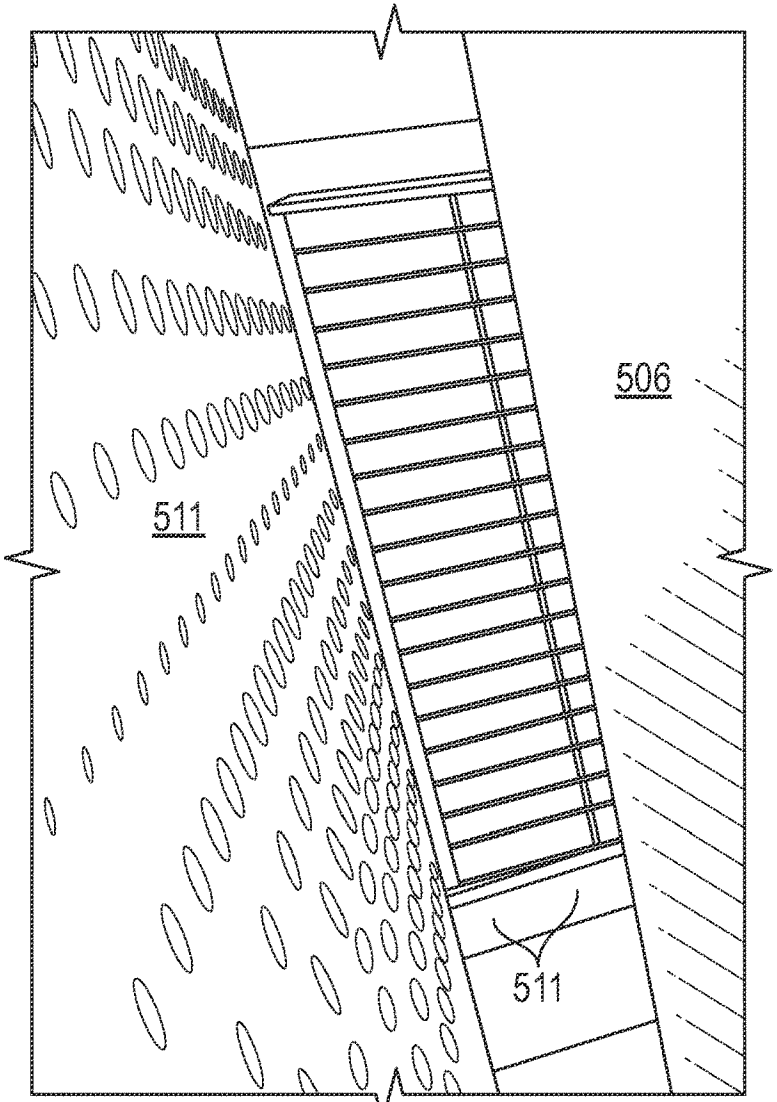

FIGS. 19-20 show the opening 510 between wall 511 and condenser coil 506, and the position (from a top view in FIG. 20) of the belt 202 of the device 200 in position to collect blown debris in the collection area between belt 202 and collecting element 204.

In one embodiment, the device 200 is constructed from 28-gauge aluminum. It should be understood that the device 200 could be made of different material without departing from the scope of the disclosure. For example, the belt 202 could be made out of molded plastic future to reduce costs, and potentially hinged at the collection element 208 end 216 to make the device 200 more conducive to space and ease of use. Any material which can withstand the flexibility and durability to be used as a belt may be used without departing from the scope of the disclosure, such as sheet metal, other plastics, or the like. The belt should have enough rigidity to withstand being introduced into a compartment of an HVAC unit, and deflect around a condenser coil as discussed, without being too flimsy that it does not maintain its integrity. The examples of aluminum and flexible plastics are examples only. Those of skill in the art will readily understand other materials may be used without departing from the scope of the disclosure.

The size and thickness of the belt 202 and collection element 204 may be changed due to regulations or different sizes of units 500. For example, due to regulations that have been enacted in 2019, it is possible that the collection area 208 comprising a portion of belt 202 and collection element 204 at the end 216 of device 200 may potentially be a little thinner than a currently embodied ¾. It is also possible that the clamps 550 could be installed on the outside of the device and integrated therewith, instead of using unattached clamps 550 as shown. Also, the length of the belt 202 may be lengthened or shortened to ensure that it is properly seated and suitable for collecting debris blown toward the collection area 208.

As has been described, the device 200 (and device 100) are used in one embodiment as follows:

Remove face plate 502

Remove condenser coil screws 504

Slide condenser coil 506 to right to create an opening 510

Insert device 200/100 into opening 510

Insert device 200 all the way until the notch below the vacuum port sits on the wall sleeve base, or insert device 100 until it is seated with the vacuum pipes at the beginning of opening 511

The belt 202/102 will hit an opening behind the unit sleeve and in front of the divider panel just past and inside the side panel assembly Clamps 550 are added to the outside of the device 200/100 and the opening 511 where the screws 504 were to tighten and secure into place to the condenser coil 506 as well as eliminate as much air loss as possible when attaching a vacuum to the port 206/106

Attached the vacuum to the port 206/106 on the device 200/100 and turn on Start blowing with air on the right side of the condenser coil 506 as shown in FIG. 20 at arrow 570 in a counterclockwise direction until air is blown over the entire coil—left to right; top to bottom, to collect and remove debris from the unit 500 condenser compartment.

The above-disclosed subject matter is to be considered illustrative, and not restrictive, and the appended claims are intended to cover all such modifications, enhancements, and other embodiments, which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A cleaning device for a compact HVAC unit, comprising:

a flexible elongate flat belt extending from a first end to a second end;

a collection element attached to the flexible elongate flat belt at the first end of the belt;

wherein the collection element and the elongate flat sheet-shaped belt form a collection area therebetween, and wherein the collection element has a port therein at the first end of the belt, the port configured to remove debris collected in the collection area.

2. The cleaning device of claim 1, wherein the flexible elongate flat belt has a bent end portion at the second end of the belt opposite from the collection element.

3. The cleaning device of claim 2, wherein the bent end portion is bent in a direction toward the collection element to form a deflection portion that assists in introducing the cleaning device into compact HVAC unit.

4. The cleaning device of claim 1, wherein the elongate flat belt includes a first notch to assist in alignment of the cleaning device in an interior of the HVAC unit.

5. The cleaning device of claim 4, wherein collection element includes a second notch positioned near the port and configured to engage an interior wall portion of the HVAC unit.

6. The cleaning device of claim 1, wherein the flexible elongate flat belt comprises an aluminum belt.

7. The cleaning device of claim 1, wherein the collection area is a pocket into which debris is blown.

8. The cleaning device of claim 1, wherein the port is configured to attach to an external vacuum to allow suction of debris from the collection area.

9. The cleaning device of claim 1, wherein the port is positioned to be at a bottom of the cleaning device when installed for cleaning of the HVAC unit.

10. The cleaning device of claim 1, wherein the collection element has a v-shaped notch distal to the port, wherein an open end of the v-shape is directed toward the second end of the belt.

11. A method, comprising:

inserting a cleaning device between a wall and a condenser coil of an HVAC unit, the cleaning device comprising an elongate flat belt that wraps at least partially around the condenser coil, a collection element on the elongate flat belt to collect debris, and a vacuum port configured to remove collected debris from the collection element;

blowing debris collected in the HVAC unit toward the collection element along the elongate flat belt; and removing collected debris with the vacuum port and an external vacuum.

12. The method of claim 11, wherein inserting comprises inserting at one end of a condenser coil of the HVAC unit and introducing the elongate flat belt around the condenser coil to an opposite side of the HVAC unit.

13. The method of claim 11, wherein the vacuum port is positioned at a low part of the HVAC unit for cleaning.

14. The method of claim 11, wherein blowing debris is performed from an end of the cleaning device opposite the vacuum port, toward the collection element and the vacuum port.

15. The method of claim 11, wherein the collection element and the elongate flat belt form a pocket for collecting debris, and wherein removing collected debris comprises vacuuming the collected debris from the pocket.

16. A method, comprising:

inserting a cleaning device having an elongate flat flexible belt, a debris collection area, and a debris removal port, between a wall and a condenser coil of an HVAC unit;

blowing debris collected in the HVAC unit along the elongate flat flexible belt toward the debris collection area; and removing the debris collected in the debris collection area via the debris removal port and an external vacuum.

17. The method of claim 16, wherein inserting comprises inserting at one end of a condenser coil of the HVAC unit and introducing the elongate flat flexible belt around the condenser coil to an opposite side of the HVAC unit.

18. The method of claim 16, wherein the debris removal port is positioned at a low part of the HVAC unit for cleaning.

19. The method of claim 16, wherein blowing debris is performed from an end of the cleaning device opposite the debris removal port, toward the debris collection area and the debris removal port.

20. The method of claim 16, wherein the debris collection area and the elongate flat flexible belt form a pocket for collecting debris, and wherein removing collected debris comprises vacuuming the collected debris from the pocket via the debris removal port.

* * * * *